US009148941B2

(12) United States Patent
Fleurov et al.

(10) Patent No.: US 9,148,941 B2
(45) Date of Patent: Sep. 29, 2015

(54) THERMAL MONITOR FOR AN EXTREME ULTRAVIOLET LIGHT SOURCE

(71) Applicant: ASML Netherlands B.V., Veldhoven (NL)

(72) Inventors: Vladimir Fleurov, Escondido, CA (US); Igor Fomenkov, San Diego, CA (US); Shailendra Srivastava, San Diego, CA (US)

(73) Assignee: ASML Netherlands B.V., Veldhoven (NL)

( * ) Notice: Subject to any disclaimer, the term of this patent is extended or adjusted under 35 U.S.C. 154(b) by 0 days.

(21) Appl. No.: 13/747,263

(22) Filed: Jan. 22, 2013

(65) Prior Publication Data

US 2014/0203195 A1 Jul. 24, 2014

(51) Int. Cl.
*H05G 2/00* (2006.01)

(52) U.S. Cl.
CPC ..... *H05G 2/008* (2013.01); *H05G 2/003* (2013.01); *H05G 2/005* (2013.01)

(58) Field of Classification Search
CPC ..... H05G 2/005; H05G 2/008
USPC ..... 250/504 R; 126/587
See application file for complete search history.

(56) References Cited

U.S. PATENT DOCUMENTS

| | | | | |
|---|---|---|---|---|
| 4,749,122 | A * | 6/1988 | Shriver et al. | 236/14 |
| 5,005,929 | A * | 4/1991 | Ota | 359/221.1 |
| 6,030,118 | A * | 2/2000 | Schneider et al. | 374/160 |
| 7,535,013 | B2 * | 5/2009 | Seki | 250/492.2 |
| 7,554,662 | B1 * | 6/2009 | Liphardt et al. | 356/369 |
| 7,641,349 | B1 * | 1/2010 | Chrobak et al. | 359/845 |
| 7,923,705 | B2 | 4/2011 | Moriya | |
| 8,476,609 | B2 * | 7/2013 | Endo et al. | 250/504 R |
| 2002/0084424 | A1 * | 7/2002 | O'Carroll et al. | 250/492.1 |
| 2004/0012404 | A1 * | 1/2004 | Feder et al. | 324/760 |
| 2005/0199829 | A1 * | 9/2005 | Partlo et al. | 250/504 R |
| 2006/0151724 | A1 * | 7/2006 | Honda et al. | 250/504 R |
| 2006/0156785 | A1 * | 7/2006 | Mankame et al. | 72/413 |
| 2006/0219957 | A1 * | 10/2006 | Ershov et al. | 250/504 R |
| 2007/0061099 | A1 * | 3/2007 | Turner et al. | 702/130 |
| 2008/0015827 | A1 * | 1/2008 | Tryon et al. | 703/2 |
| 2008/0017810 | A1 * | 1/2008 | Frijns | 250/492.2 |
| 2009/0073396 | A1 * | 3/2009 | Gabriel Van De Vijver et al. | 355/30 |
| 2009/0127479 | A1 * | 5/2009 | Hosokai et al. | 250/504 R |
| 2009/0275815 | A1 * | 11/2009 | Bickoff et al. | 600/345 |
| 2010/0078577 | A1 * | 4/2010 | Moriya et al. | 250/504 R |
| 2010/0078580 | A1 * | 4/2010 | Endo et al. | 250/504 R |
| 2010/0171049 | A1 * | 7/2010 | Moriya et al. | 250/504 R |
| 2010/0200777 | A1 * | 8/2010 | Hauf | 250/504 R |

(Continued)

OTHER PUBLICATIONS

International Search Report in International Application No. PCT/US13/75871, mailed Feb. 21, 2014, 12 pages.

*Primary Examiner* — Phillip A Johnston
*Assistant Examiner* — Sean Luck
(74) *Attorney, Agent, or Firm* — DiBerardino McGovern IP Group LLC

(57) ABSTRACT

A first temperature distribution that represents a temperature of an element adjacent to and distinct from a first optical element that is positioned to receive an amplified light beam is accessed. The accessed first temperature distribution is analyzed to determine a temperature metric associated with the element, the determined temperature metric is compared to a baseline temperature metric, and an adjustment to position of the amplified light beam relative to the first optical element is determined based on the comparison.

28 Claims, 9 Drawing Sheets

(56) References Cited

U.S. PATENT DOCUMENTS

| | | | | |
|---|---|---|---|---|
| 2010/0243922 | A1* | 9/2010 | Asayama et al. | 250/504 R |
| 2011/0051897 | A1* | 3/2011 | Ahn et al. | 378/119 |
| 2011/0106484 | A1* | 5/2011 | Quinn et al. | 702/135 |
| 2011/0109740 | A1* | 5/2011 | Guha et al. | 348/143 |
| 2011/0140008 | A1 | 6/2011 | Bergstedt et al. | |
| 2011/0141865 | A1* | 6/2011 | Senekerimyan et al. | 369/47.15 |
| 2011/0174996 | A1* | 7/2011 | Someya et al. | 250/504 R |
| 2011/0180734 | A1* | 7/2011 | Moriya et al. | 250/504 R |
| 2011/0226745 | A1* | 9/2011 | Nagai et al. | 219/121.62 |
| 2011/0253913 | A1* | 10/2011 | Nagai et al. | 250/504 R |
| 2011/0318694 | A1* | 12/2011 | Levesque et al. | 430/319 |
| 2012/0156809 | A1* | 6/2012 | Shirai | 438/7 |
| 2012/0210999 | A1* | 8/2012 | Straeter | 126/586 |
| 2013/0043401 | A1* | 2/2013 | Graham et al. | 250/372 |

* cited by examiner

THERMAL MONITOR FOR AN EXTREME ULTRAVIOLET LIGHT SOURCE

TECHNICAL FIELD

This disclosure relates to a thermal monitor for an extreme ultraviolet (EUV) light source.

BACKGROUND

Extreme ultraviolet ("EUV") light, for example, electromagnetic radiation having wavelengths of around 50 nm or less (also sometimes referred to as soft x-rays), and including light at a wavelength of about 13 nm, can be used in photolithography processes to produce extremely small features in substrates, for example, silicon wafers.

Methods to produce EUV light include, but are not necessarily limited to, converting a material into a plasma state that has an element, for example, xenon, lithium, or tin, with an emission line in the EUV range. In one such method, often termed laser produced plasma ("LPP"), the required plasma can be produced by irradiating a target material, for example, in the form of a droplet, stream, or cluster of material, with an amplified light beam that can be referred to as a drive laser. For this process, the plasma is typically produced in a sealed vessel, for example, a vacuum chamber, and monitored using various types of metrology equipment.

SUMMARY

In one general aspect, a method for adjusting a position of an amplified light beam relative to a first optical element in an extreme ultraviolet (EUV) light source includes accessing a first temperature distribution that represents a temperature of an element adjacent to and distinct from the first optical element. The first optical element is positioned to receive the amplified light beam. The method also includes analyzing the accessed first temperature distribution to determine a temperature metric associated with the element, comparing the determined temperature metric to a baseline temperature metric, and determining an adjustment to position of the amplified light beam relative to the first optical element based on the comparison.

Implementations can include one or more of the following features. An indication that represents the determined adjustment to the position of the amplified light beam can be produced. The indication can include inputs for an actuator mechanically coupled to a second optical element, the second optical element can include an active area positioned to receive the amplified light beam, and the inputs to the actuator can be sufficient to cause the actuator to move the active area in at least one direction. The inputs can be provided to the actuator. After providing the inputs to the actuator, a second temperature distribution of the element that is adjacent to the first optical element can be accessed, the second temperature distribution can be analyzed to determine the temperature metric, and the temperature metric can be compared to one or more of the first temperature distribution or the baseline temperature metric.

The indicator can also include inputs for a second actuator coupled to a third optical element in the EUV light source, the inputs to the second actuator being sufficient to cause the second actuator to move the third optical element in at least one direction. The active area of the second optical element can include a mirror having a reflective portion that receives the amplified light beam, and when moved, the reflective portion changes the position of the amplified light beam relative to the first optical element.

The first temperature distribution can include a temperature of a portion of the element that is adjacent to the first optical element, the temperature of the portion being measured at least at two different times. The first temperature distribution can include a temperature of multiple portions of the element that is adjacent to the first optical element. The temperature of each of the multiple portions can be measured at least at two different times. The first temperature distribution can include data that represents temperature measurements received from thermal sensors mechanically coupled to the element that is adjacent to the first optical element. The first temperature distribution can include multiple temperatures of the element measured at different times, and temperature metric can include one or more of a variance of the multiple temperatures, an average of the multiple temperatures, or a rate of change between of at least two of the multiple temperatures.

The first optical element can be a converging lens through which the amplified light beam passes, and the element that is adjacent to the converging lens can be a lens shield.

The first temperature distribution can include multiple temperatures measured at different locations on the element at a particular time, and the temperature metric can include a spatial variance of the multiple temperatures. The first temperature distribution also can include multiple temperatures of the element measured at different locations on the element that is adjacent to the first optical element. The temperature metric also can include a spatial variance of the multiple temperatures measured at different locations on the element that is adjacent to the first optical element. The temperature metric can include a value representing a temporal change in measured temperature of the element that is adjacent to the first optical element, and comparing the temperature metric to a baseline temperature metric can include comparing the value to a threshold.

In another general aspect, a system includes a thermal sensor configured to mechanically couple to a element adjacent to a first optical element that receives an amplified light beam of an extreme ultraviolet (EUV) light source, measure a temperature of the element, and generate an indication of the measured temperature. The system also includes a controller including one or more electronic processors coupled to a non-transitory computer-readable medium, the computer-readable medium storing software including instructions executable by the one or more electronic processors, the instructions, when executed, cause the one or more electronic processors to receive the generated indication of the measured temperature, and produce an output signal based on the generated indication of the measured temperature, the output signal being sufficient to cause an actuator to move a second optical element that receives the amplified light beam and adjust a position the amplified light beam relative to the first optical element. Implementations can include one or more of the following features. The first optical element can be a lens through which the amplified light beam passes, the element adjacent to the lens can be a lens shield adjacent to the lens, and the thermal sensors can be configured to be mounted to the lens shield. The thermal sensors can include one or more of thermocouple, a thermistor, or a fiber-based thermal sensor. The first optical element can be one of a power amplifier output window, a final focus turning mirror, or a spatial filter aperture. The thermal sensor can include a plurality of thermal sensors, the first optical element can include one or more optical elements that are downstream of a lens that focuses the amplified light beam, and each of the one or more optical elements can be coupled to a thermal sensor. The one or more optical elements can be mirrors.

The instructions also can include instructions to provide the output signal to the actuator, and the actuator can be configured to couple to the second optical element. The instructions can also include instructions that, when executed, cause the controller to access a first temperature distribution, the first temperature distribution based on indications of the measured temperature of the element from the thermal sensor, analyze the accessed temperature distribution to determine a temperature metric associated with the element, compare the determined temperature metric to a baseline temperature distribution, and determine an adjustment to a parameter of the amplified light beam based on the comparison.

In another general aspect, a system includes a first optical element that receives an amplified light beam of an extreme ultraviolet (EUV) light source, and an element adjacent to and distinct from the first optical element. The system also includes a thermal system coupled to the element adjacent to the first optical element, and the thermal system includes one or more temperature sensors, each associated with a different portion of the element, the one or more temperature sensors configured to generate an indication of a measured temperature of an associated portion of the element, and an actuation system coupled to a second optical element that, when moved, causes a corresponding movement in the amplified light beam. The system also includes a control system connected to an output of the thermal system and to one or more inputs of the actuation system and configured to produce an output signal for the actuation system inputs based on the generated indication of the measured temperature, the output signal being sufficient to cause an actuator to move the second optical element and adjust a position the amplified light beam relative to the first optical element.

Implementations of any of the techniques described above may include a method, a process, a device, a kit for retrofitting an existing EUV light source, or an apparatus. The details of one or more implementations are set forth in the accompanying drawings and the description below. Other features will be apparent from the description and drawings, and from the claims.

DRAWING DESCRIPTION

DESCRIPTION

Figure 1A:
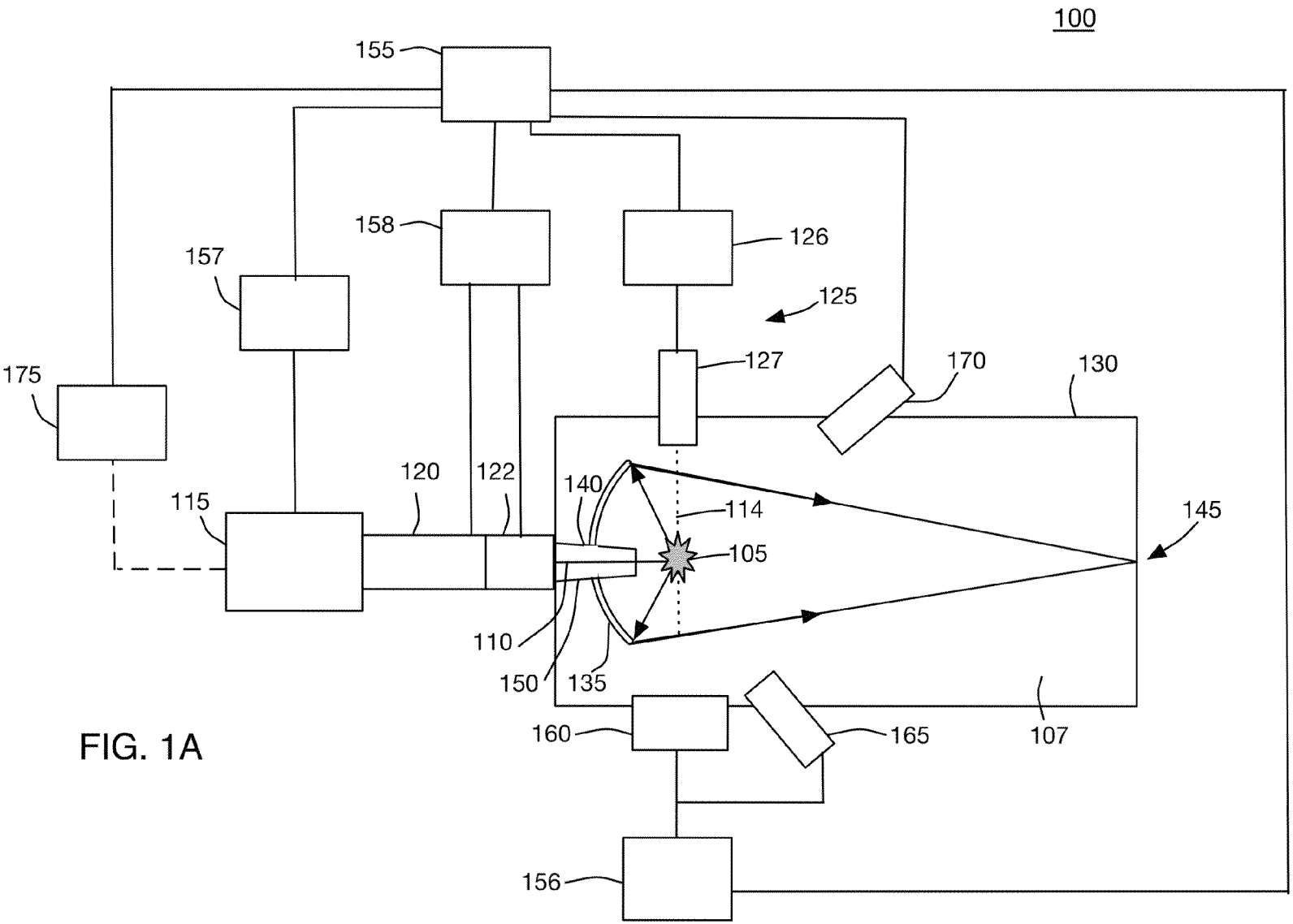
FIG. 1A is a block diagram of a laser produced plasma extreme ultraviolet light source.

A thermal monitor for an extreme ultraviolet (EUV) light source is disclosed. The thermal monitor determines a temperature of an element that is adjacent to, and distinct from, an optical element that receives an amplified light beam. The amplified light beam is directed towards a stream of target material droplets, and, when the amplified light beam interacts with a target material droplet, the target material droplet is converted into a plasma state and emits EUV light.

The thermal monitor can improve the performance of the EUV source by providing more accurate positioning of the amplified light beam relative to the optical elements that reflect or refract the beam. Because the EUV light is produced by irradiating a target material droplet with the amplified light beam, aligning the amplified light beam so that the beam is focused at a target location through which the target material droplets pass can provide concentrated energy to the droplet, making it more likely that the droplet is converted into a plasma, thus increasing the amount of EUV light produced and improving overall performance of the EUV light source. Further, maintaining the alignment and quality of the amplified light beam may improve the stability of the EUV power that the light source produces. Additionally, monitoring the spatial temperature distribution and the symmetry of the intensity on elements that receive the amplified light beam also allows for compensation of errors introduced by thermal drift.

As discussed below, monitoring the temperature of an element (such as a lens shield) that is adjacent to an optical element that receives the amplified light beam (such as a lens or a mirror) can improve the alignment of the amplified light beam. Direct and indirect radiation on an element can heat the element, producing a measurable change in the element's temperature. The amount of radiation from the amplified light beam that the element absorbs or is exposed to depends on the quality of the alignment of the beam. For example, if the amplified light beam is well collimated and aligned relative to a lens, the intensity distribution of the beam on the lens is substantially uniform spatially and/or temporally. When the amplified light beam is well collimated, the intensity distribution is symmetrically shaped and centered on the lens and elements adjacent to the lens. Because the intensity distribution on the lens is uniform, the heating on the lens and the elements adjacent to the lens is also uniform. Additionally, the intensity distribution of the beam that is reflected off of the material droplets is collimated and uniform.

In contrast, if the amplified light beam is misaligned, the intensity distribution of the amplified light beam on the lens and the intensity distribution of the reflected beam are not uniform. For example, when misaligned, the amplified light beam can pass through the lens off-center and can have an asymmetrical intensity distribution, potentially causing certain portions of the lens and/or the adjacent element to heat more than other portions. The non-uniform heating can lead to localized hot spots that can result in thermal damage to the lens and/or the adjacent element. Additionally, the hot spots can cause optical effects in the lens, such as thermal lensing, which can change the focal distance of the lens due to changes in the index of refraction and degrade performance of the light source. Optical effects are those effects on the lens that change the optical properties of the lens. Further, when misaligned, the amplified light beam may strike a mirror off-center and hit non-reflective elements or hit a non-transmissive element adjacent to an aperture or lens. In both of these examples, the amplified light beam can become asymmetrical and cause an adjacent element to have a non-uniform intensity distribution.

In other words, inaccurate alignment of the amplified light beam can result in the temperature distribution on the lens being non-uniform in time and/or space. Consequently, the temperature of various portions of a thermally conductive element or component adjacent to the lens can also be non-uniform. Therefore, measurement of a non-uniform temperature distribution on the adjacent component can be an indication of a misalignment of the amplified light beam. Further, by characterizing the temperature distribution on the adjacent component, an amount of misalignment can be determined and used to adjust or correct the alignment of the amplified light beam by adjusting the position of optical elements that direct the amplified beam of light towards the target material droplets.

Additionally, characterization of the temperature distribution on the adjacent component allows for compensation for performance changes caused by thermal drift. Optical components in the EUV light source can expand in size when exposed to heat. For example, a mirror or a mount that holds the mirror can expand in response to being heated rapidly and/or heated for a long period of time. Such additional heating can occur when the duty cycle of the amplified light beam is increased. The thermal expansion can lead to a slight change in position of the mirror, causing pointing drift, which is a change in the direction in which light reflected from the mirror travels. Pointing drift can result in the amplified light beam not being centered on optical elements that are downstream from the mirror. Pointing drift can also lead to an asymmetrical intensity distribution on the downstream optical elements.

The thermal monitor discussed below can also be used to compensate for pointing drift by determining whether the amplified light beam is asymmetrically positioned on optical elements, and, if the beam is asymmetrically positioned, repositioning the amplified light beam such that the beam is centered on the optical elements with a symmetrical intensity distribution.

As such, the thermal monitoring technique discussed below can improve performance of an EUV light source by improving alignment of the amplified light beam and compensating for thermal drift. The EUV light source is discussed before discussing the thermal monitor in more detail.

Referring to FIG. 1A, an LPP EUV light source 100 is formed by irradiating a target mixture 114 at a target location 105 with an amplified light beam 110 that travels along a beam path toward the target mixture 114. The target location 105, which is also referred to as the irradiation site, is within an interior 107 of a vacuum chamber 130. When the amplified light beam 110 strikes the target mixture 114, a target material within the target mixture 114 is converted into a plasma state that has an element with an emission line in the EUV range. The created plasma has certain characteristics that depend on the composition of the target material within the target mixture 114. These characteristics can include the wavelength of the EUV light produced by the plasma and the type and amount of debris released from the plasma.

The light source 100 also includes a target material delivery system 125 that delivers, controls, and directs the target mixture 114 in the form of liquid droplets, a liquid stream, solid particles or clusters, solid particles contained within liquid droplets or solid particles contained within a liquid stream. The target mixture 114 includes the target material such as, for example, water, tin, lithium, xenon, or any material that, when converted to a plasma state, has an emission line in the EUV range. For example, the element tin can be used as pure tin (Sn); as a tin compound, for example, $SnBr_4$, $SnBr_2$, $SnH_4$; as a tin alloy, for example, tin-gallium alloys, tin-indium alloys, tin-indium-gallium alloys, or any combination of these alloys. The target mixture 114 can also include impurities such as non-target particles. Thus, in the situation in which there are no impurities, the target mixture 114 is made up of only the target material. The target mixture 114 is delivered by the target material delivery system 125 into the interior 107 of the chamber 130 and to the target location 105.

The light source 100 includes a drive laser system 115 that produces the amplified light beam 110 due to a population inversion within the gain medium or mediums of the laser system 115. The light source 100 includes a beam delivery system between the laser system 115 and the target location 105, the beam delivery system including a beam transport system 120 and a focus assembly 122. The beam transport system 120 receives the amplified light beam 110 from the laser system 115, and steers and modifies the amplified light beam 110 as needed and outputs the amplified light beam 110 to the focus assembly 122. The focus assembly 122 receives the amplified light beam 110 and focuses the beam 110 to the target location 105.

In some implementations, the laser system 115 can include one or more optical amplifiers, lasers, and/or lamps for providing one or more main pulses and, in some cases, one or more pre-pulses. Each optical amplifier includes a gain medium capable of optically amplifying the desired wavelength at a high gain, an excitation source, and internal optics. The optical amplifier may or may not have laser mirrors or other feedback devices that form a laser cavity. Thus, the laser system 115 produces an amplified light beam 110 due to the population inversion in the gain media of the laser amplifiers even if there is no laser cavity. Moreover, the laser system 115 can produce an amplified light beam 110 that is a coherent laser beam if there is a laser cavity to provide enough feedback to the laser system 115. The term "amplified light beam" encompasses one or more of: light from the laser system 115 that is merely amplified but not necessarily a coherent laser oscillation and light from the laser system 115 that is amplified and is also a coherent laser oscillation.

The optical amplifiers in the laser system 115 can include as a gain medium a filling gas that includes $CO_2$ and can amplify light at a wavelength of between about 9100 and about 11000 nm, and in particular, at about 10600 nm, at a gain greater than or equal to 1000. Suitable amplifiers and lasers for use in the laser system 115 can include a pulsed laser device, for example, a pulsed, gas-discharge $CO_2$ laser device producing radiation at about 9300 nm or about 10600 nm, for example, with DC or RF excitation, operating at relatively high power, for example, 10 kW or higher and high pulse repetition rate, for example, 50 kHz or more. The optical amplifiers in the laser system 115 can also include a cooling system such as water that can be used when operating the laser system 115 at higher powers.

Figure 1B:
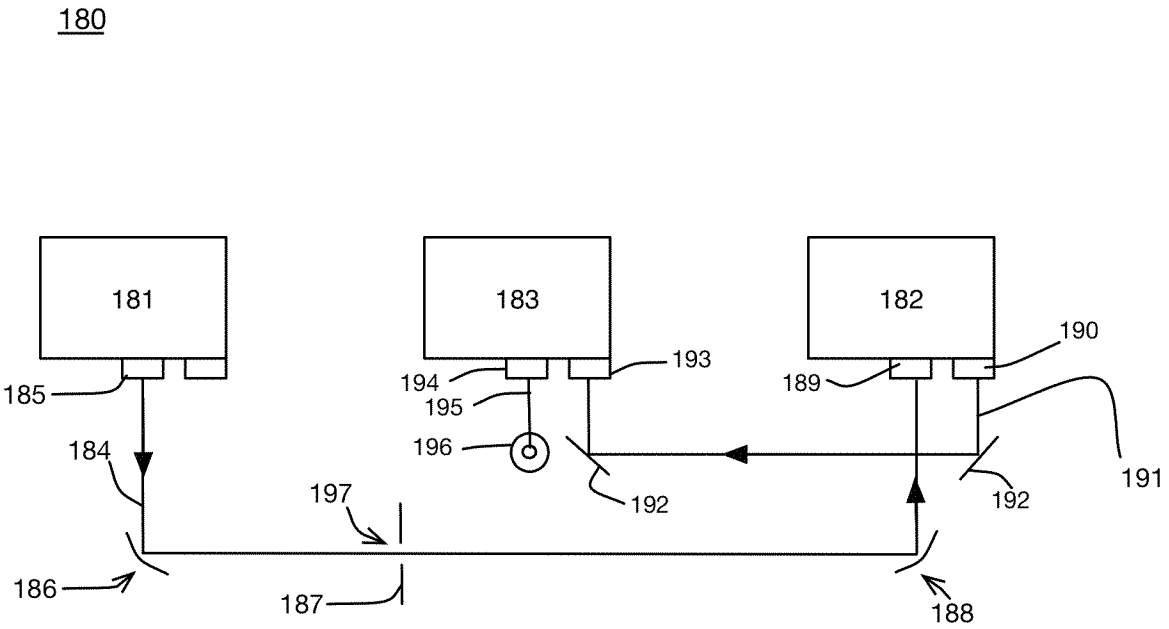
FIG. 1B is a block diagram of an example drive laser system that can be used in the light source of FIG. 1A.

FIG. 1B shows a block diagram of an example drive laser system 180. The drive laser system 180 can be used as the drive laser system 115 in the source 100. The drive laser system 180 includes three power amplifiers 181, 182, and 183. Any or all of the power amplifiers 181, 182, and 183 can include internal optical elements (not shown).

Light 184 exits from the power amplifier 181 through an output window 185 and is reflected off a curved mirror 186. After reflection, the light 184 passes through a spatial filter 187, is reflected off of a curved mirror 188, and enters the power amplifier 182 through an input window 189. The light 184 is amplified in the power amplifier 182 and redirected out of the power amplifier 182 through an output window 190 as light 191. The light 191 is directed towards the amplifier 183 with fold mirrors 192 and enters the amplifier 183 through an input window 193. The amplifier 183 amplifies the light 191 and directs the light 191 out of the amplifier 193 through an output window 194 as an output beam 195. A fold mirror 196 directs the output beam 195 upwards (out of the page) and towards the beam transport system 120.

The spatial filter 187 defines an aperture 197, which can be, for example, a circle having a diameter between about 2.2 mm and 3 mm. The curved mirrors 186 and 188 can be, for example, off-axis parabola mirrors with focal lengths of about 1.7 m and 2.3 m, respectively. The spatial filter 187 can be positioned such that the aperture 197 coincides with a focal point of the drive laser system 180.

Referring again to FIG. 1A, the light source 100 includes a collector mirror 135 having an aperture 140 to allow the amplified light beam 110 to pass through and reach the target location 105. The collector mirror 135 can be, for example, an ellipsoidal mirror that has a primary focus at the target location 105 and a secondary focus at an intermediate location 145 (also called an intermediate focus) where the EUV light can be output from the light source 100 and can be input to, for example, an integrated circuit lithography tool (not shown). The light source 100 can also include an open-ended, hollow conical shroud 150 (for example, a gas cone) that tapers toward the target location 105 from the collector mirror 135 to reduce the amount of plasma-generated debris that enters the focus assembly 122 and/or the beam transport system 120 while allowing the amplified light beam 110 to reach the target location 105. For this purpose, a gas flow can be provided in the shroud that is directed toward the target location 105.

The light source 100 can also include a master controller 155 that is connected to a droplet position detection feedback system 156, a laser control system 157, and a beam control system 158. The light source 100 can include one or more target or droplet imagers 160 that provide an output indicative of the position of a droplet, for example, relative to the target location 105 and provide this output to the droplet position detection feedback system 156, which can, for example, compute a droplet position and trajectory from which a droplet position error can be computed either on a droplet by droplet basis or on average. The droplet position detection feedback system 156 thus provides the droplet position error as an input to the master controller 155. The master controller 155 can therefore provide a laser position, direction, and timing correction signal, for example, to the laser control system 157 that can be used, for example, to control the laser timing circuit and/or to the beam control system 158 to control an amplified light beam position and shaping of the beam transport system 120 to change the location and/or focal power of the beam focal spot within the chamber 130.

The target material delivery system 125 includes a target material delivery control system 126 that is operable in response to a signal from the master controller 155, for example, to modify the release point of the droplets as released by a target material supply apparatus 127 to correct for errors in the droplets arriving at the desired target location 105.

Additionally, the light source 100 can include a light source detector 165 that measures one or more EUV light parameters, including but not limited to, pulse energy, energy distribution as a function of wavelength, energy within a particular band of wavelengths, energy outside of a particular band of wavelengths, and angular distribution of EUV intensity and/or average power. The light source detector 165 generates a feedback signal for use by the master controller 155. The feedback signal can be, for example, indicative of the errors in parameters such as the timing and focus of the laser pulses to properly intercept the droplets in the right place and time for effective and efficient EUV light production.

The light source 100 can also include a guide laser 175 that can be used to align various sections of the light source 100 or to assist in steering the amplified light beam 110 to the target location 105. In connection with the guide laser 175, the light source 100 includes a metrology system 124 that is placed within the focus assembly 122 to sample a portion of light from the guide laser 175 and the amplified light beam 110. In other implementations, the metrology system 124 is placed within the beam transport system 120. The metrology system 124 can include an optical element that samples or re-directs a subset of the light, such optical element being made out of any material that can withstand the powers of the guide laser beam and the amplified light beam 110. A beam analysis system is formed from the metrology system 124 and the master controller 155 since the master controller 155 analyzes the sampled light from the guide laser 175 and uses this information to adjust components within the focus assembly 122 through the beam control system 158.

Thus, in summary, the light source 100 produces an amplified light beam 110 that is directed along the beam path to irradiate the target mixture 114 at the target location 105 to convert the target material within the mixture 114 into plasma that emits light in the EUV range. The amplified light beam 110 operates at a particular wavelength (that is also referred to as a source wavelength) that is determined based on the design and properties of the laser system 115. Additionally, the amplified light beam 110 can be a laser beam when the target material provides enough feedback back into the laser system 115 to produce coherent laser light or if the drive laser system 115 includes suitable optical feedback to form a laser cavity.

Figures 2A, 2B:
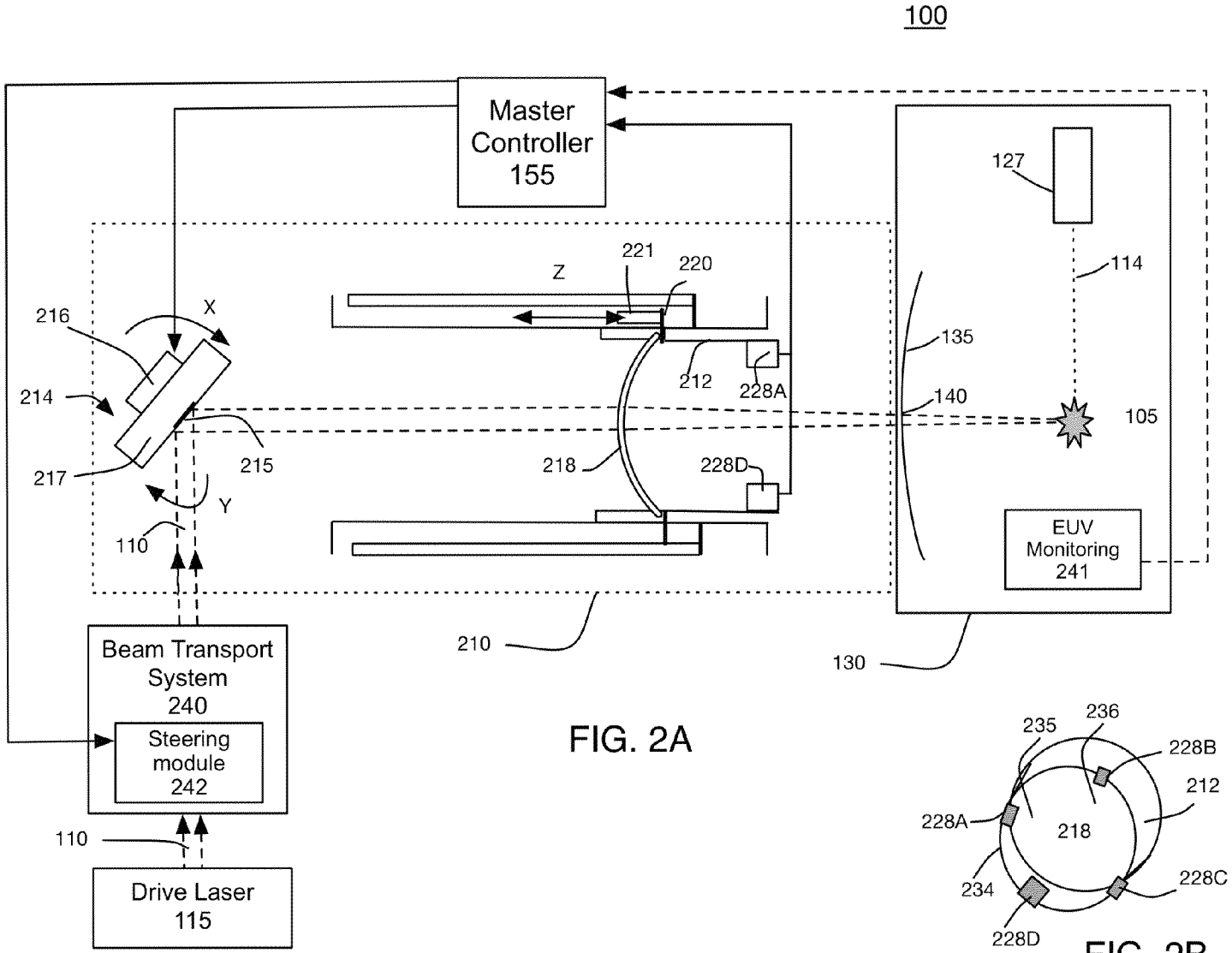
FIG. 2A is a side view of an example implementation of the light source of FIG. 1A.
FIG. 2B is a front view of the lens shield of FIG. 2A taken along line 2B-2B.

Referring to FIG. 2A, the light source 100 includes, in an exemplary implementation, a final focus assembly 210 and a beam transport system 240 that are positioned between the drive laser system 115 and the target location 105. The final focus assembly 210 focuses the amplified light beam 110 at the target location 105 in the vacuum vessel 130. The drive laser system 115 generates the amplified light beam 110, which is received by the beam transport system 240. After passing through the beam transport system 240, the amplified light beam 110 reaches the final focus assembly 210. The final focus assembly 210 focuses the amplified light beam 110 and directs the beam 110 to the vacuum vessel 130.

As discussed below, the alignment of the amplified light beam 110 can be actively adjusted while the light source 100 is in operation. In particular, in response to determining that a non-uniform temperature distribution exists on a lens holder 212, the master controller 155 controls steering elements in the final focus assembly 210 and/or the beam transport system 240 by moving and/or repositioning the steering elements. Moving and/or repositioning the steering elements can adjust a position of the amplified light beam 110 adjusted so that the amplified light beam 110 is aligned to maximize production of EUV light. The steering elements can be any element in the light source 100 that can affect the position and/or direction of the amplified light beam 110.

The beam transport system 240 includes a steering module 242. The steering module 242 includes one or more optical components (such as mirrors) that, when positioned or moved, cause a corresponding change in a position of the amplified light beam 110. The master controller 155 controls the optical components of the steering module 242 by, for example, providing signals to the optical components to cause the components to move or change position. Examples of optical components in the steering module 242 are discussed below with respect to FIG. 6. Interaction between the master controller 155 and the optical elements of the steering module 242 is discussed below with respect to FIGS. 7 and 8.

The final focus assembly 210 includes a steering mirror 214, the lens holder 212, a final focus lens 218, a support bracket 220, and a positioning actuator 221. The steering mirror 214 receives the beam 110 from the beam transport system 240 and reflects the beam 110 towards the final focus lens 218, which focuses the beam 110 at the target location 105. Because the interaction between the focused beam 110 and the droplet results in the generation of EUV light, and maintaining the proper alignment of the beam 110 can help keep the focus at the target location 105, monitoring the position and quality of the beam 110 and repositioning the beam 110 in response to the monitoring can improve the performance of the light source 100.

The lens holder 212 surrounds the lens 218, and the temperature of the lens holder 212 is proportional to a temperature on a surface of the lens 218. FIG. 2B shows a front view of an exemplary implementation of the lens holder 212 taken along line 2B-2B in FIG. 2A. In the example shown in FIGS. 2A and 2B, the lens holder 212 is a heat shield that extends outward from the lens 218. The temperature of different portions of the lens holder 212 is measured by temperature sensors 228A, 228B, 228C, and 228D. The temperature sensors 228A, 228B, 228C, and 228D are approximately equally spaced from each other along a circumference 234 of the lens holder 212. The temperature sensors 228A-228D may be placed on an inner surface 237 and/or on an outer surface 238 of the lens holder 212. Although the sensors 228A-228D are shown as being placed along an outer circumference of the lens holder 212, this is not necessarily the case. The sensors 228A-228D can be placed anywhere on the inner surface 237 and/or the outer surface 238 of the lens holder 212.

The temperature measured by any one of the sensors 228A-D is proportional to the temperature of a portion of the lens 218 that is closest to the particular temperature sensor. For example, the temperature measured by the temperature sensor 228A is indicative of the temperature on a portion 235 of the lens 218. Similarly, the temperature measured by the temperature sensor 228B is indicative of the temperature on a portion 236 of the lens 218, respectively.

Like the beam transport system 240, the final focus assembly 210 includes optical elements that steer the beam 110 and can be adjusted to correct for misalignment. For example, the final focus assembly 210 includes a steering mirror 214. The steering mirror 214 includes a holder 217 with a reflective portion 215 that reflects the amplified light beam 110, and an actuator 216 that moves the holder 217 and/or the reflective portion 215 in either or both of two directions "X" and "Y" in response to receiving a command signal from the master controller 155. Thus, the steering mirror 214 can direct the amplified light beam 110 to a particular portion of the final focus lens 218. This can help ensure that the light beam 110 is focused at the target location 105. The final focus assembly 210 also includes the positioning actuator 221 that moves the lens 218 along the direction "X" to further adjust the position of the focus of the beam 110.

The amplified light beam 110 passes from the final focus assembly 210 into the vacuum vessel 130. The amplified light beam 110 passes through the aperture 140 in the collector mirror 135 and propagates toward the target location 105. The amplified light beam 110 interacts with droplets in the target mixture 114 to produce EUV light. The vacuum vessel 130 is monitored by a EUV monitoring module 241. The EUV monitoring module 241 can include the light source detector 165 discussed with respect to FIG. 1A. The output of the EUV monitoring module 241 are provided to the master controller 155 and also can be used to monitor the amount of EUV light produced. For example, the output of the EUV monitoring module 241 can be used to adjust the components in the steering module 242 and/or the steering mirror 214 to maximize the amount of EUV light produced at the target location 105.

Figure 3B:
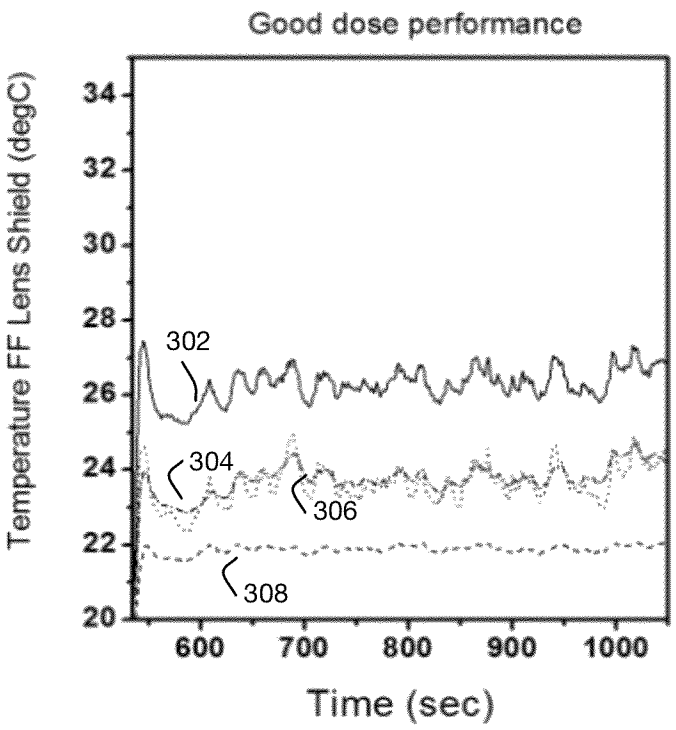
FIGS. 3A and 3B are examples of measured temperature as a function of time.
Figure 3A:
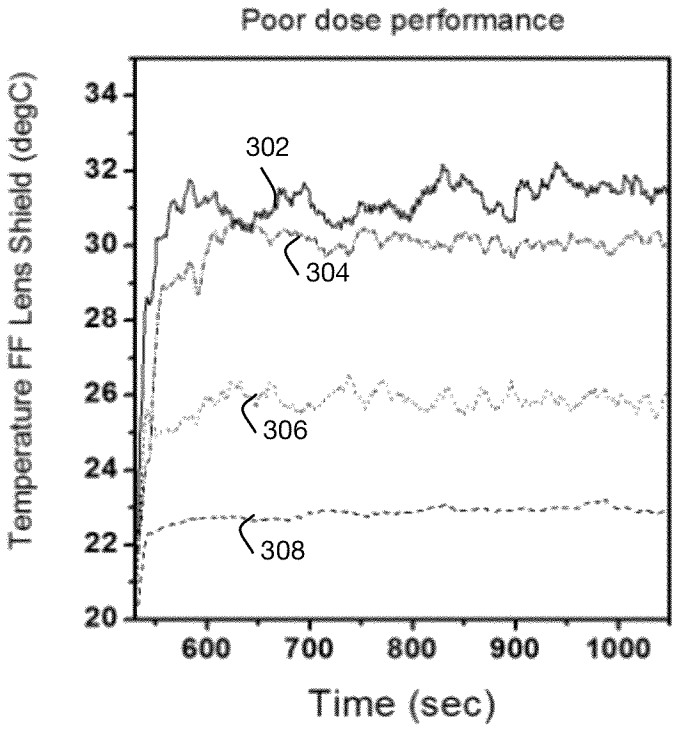

FIGS. 3A and 3B show temperature as a function of time as measured by four thermocouples coupled to the surface of a final focus lens shield. The final focus lens shield can be similar to the lens holder 212 discussed above. The thermocouples can be positioned on the lens shield in a manner that is similar to the sensors 228A-228D (FIGS. 2A and 2D). In FIGS. 3A and 3B, time series 302, 304, 306, and 308 each represent temperature measured by a particular thermocouple over time.

FIG. 3A shows an example based on data collected when the light source 100 was producing a relatively unstable amount of EUV power, and FIG. 3B shows an example based on data collected with the light source 100 was producing a relatively stable (or constant) amount of EUV power. The final focus lens shield can be similar to the lens holder 212 shown in FIG. 2B.

In the examples shown, the light source 100 was operating in a mini-burst mode at a 900 Hz burst rate. Comparing FIG. 3A to FIG. 3B, the temperature of the final focus lens shield is relatively more constant over time when the light source 100 produces stable EUV power (FIG. 3B) than when the light source 100 produces relatively unstable EUV power. For example, FIG. 3B shows that a temperature deviation of about 1-2 degrees Celsius over time and about 2-4 degrees Celsius among the four thermocouples at a particular time can occur even when the light source 100 is producing relatively stable EUV power. In contrast, FIG. 3A shows a larger variation in the temperature measured by a particular thermocouple over time and in the temperature measured by all of the thermocouples at a particular time. As such, by measuring the temperature at various locations on the lens shield over time, and adjusting the beam until the temperature distributions measured on the heat shield become relatively constant in time and/or space, the stability and amount of EUV power generated by the light source 100 can be improved.

Figure 4A:
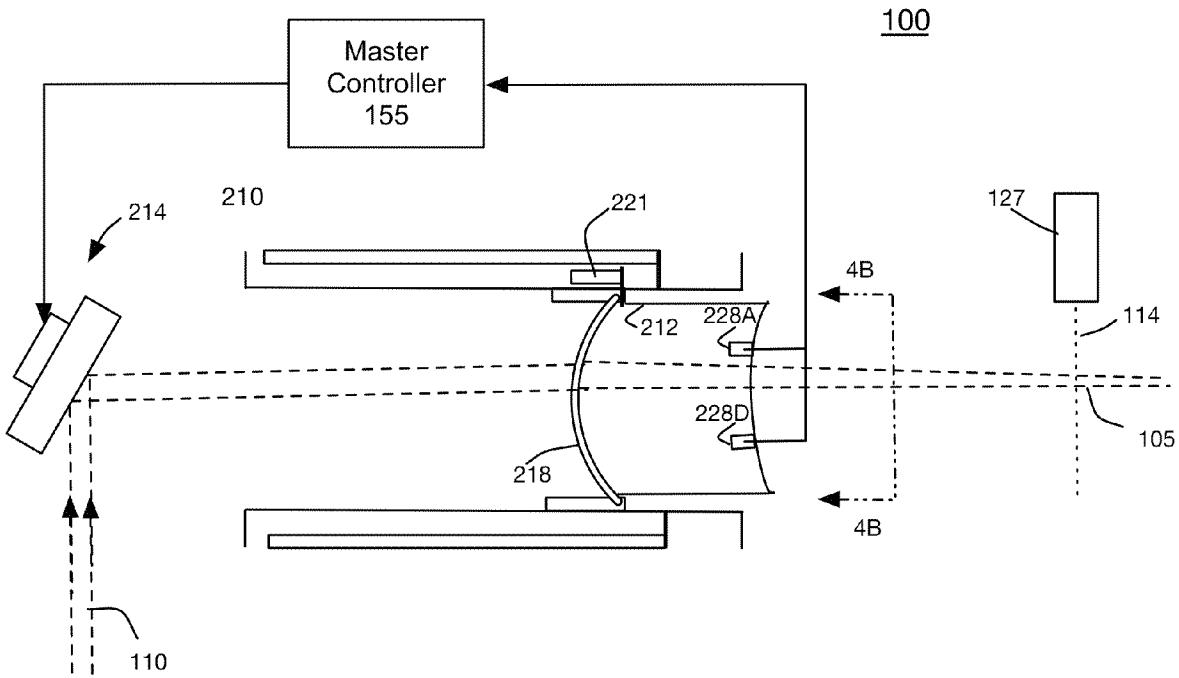
FIG. 4A is a side view of the example implementation of the light source of FIG. 2A with a misaligned amplified light beam.
Figure 4B:
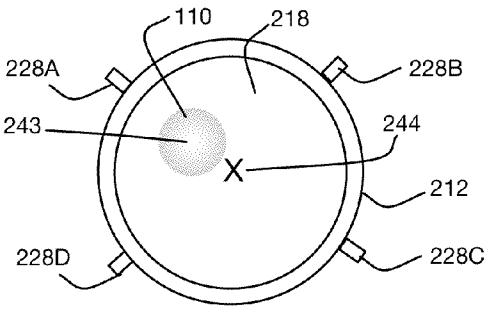
FIG. 4B is a front view of the final focus lens of FIG. 4A.
Figure 5A:
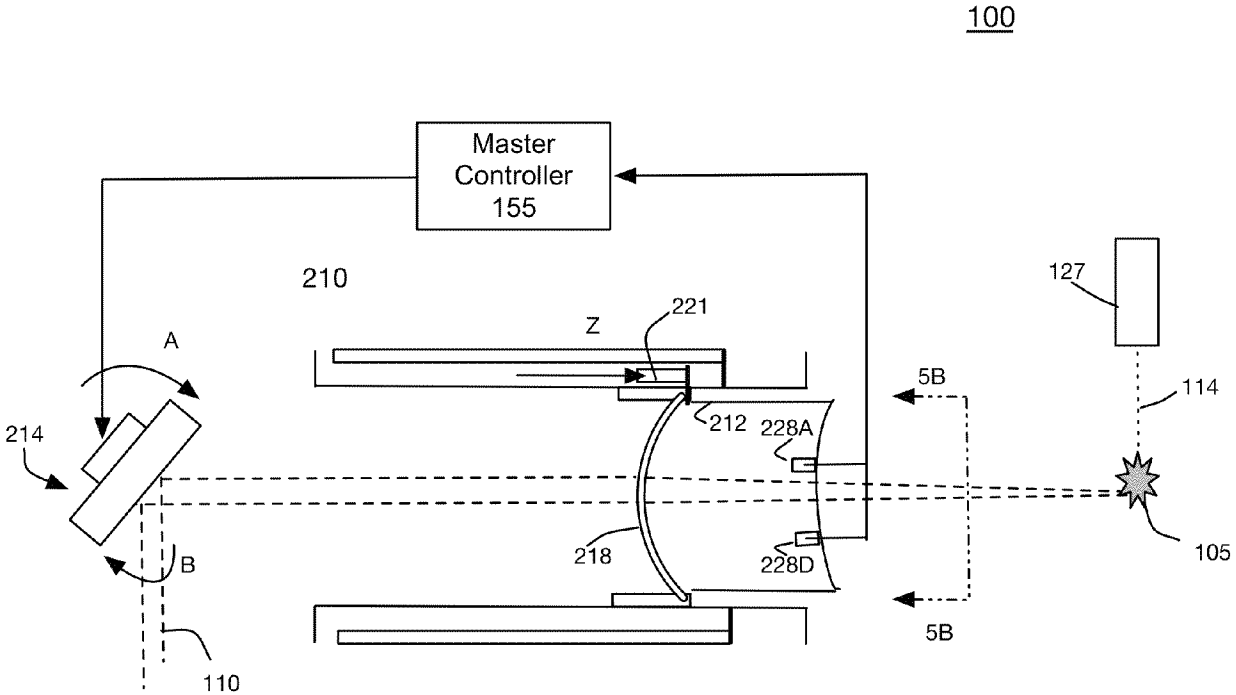
FIG. 5A is a side view of the example implementation of the light source of FIG. 2A with an aligned amplified light beam.
Figure 5B:
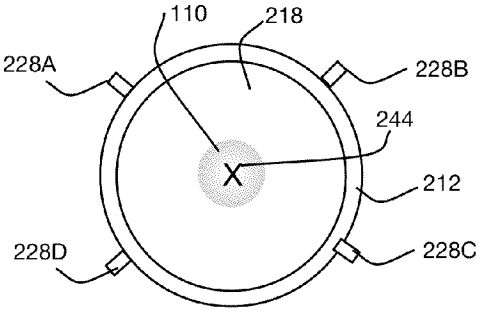
FIG. 5B is a front view of the final focus lens of FIG. 5A.

Referring to FIGS. 4A-5B, FIG. 4A is a side view of the final focus lens assembly 210 with the beam 110 misaligned, and FIG. 4B shows a front view of the final focus lens 218 and the beam 110 taken along line 4B-4B in FIG. 4A. FIG. 5A is a side view of the final focus lens assembly 210 with the beam 110 properly aligned. FIG. 5B shows a front view of the final focus lens 218 taken along line 5B-5B in FIG. 5A.

In the example shown in FIGS. 4A and 4B, the beam 110 is misaligned and passes through the final focus lens 218 at a location 243, away from a center 244 of the lens 218. As a result, a portion of the lens 218 close to the temperature sensor 228A is warmer than the other portions of the lens 218, and the sensor 228A produces a higher temperature reading than the sensors 228B, 228C, and 228D. Further, because the beam 110 does not pass through the center 244 of the lens 218, the beam 110 does not come to a focus at the target location 105. Consequently, the droplets in the target mixture 114 may not be as readily converted into a plasma, resulting in little or no generated EUV light.

The temperature readings from the sensors 228A-228D are provided to the master controller 155. The master controller 155 compares the temperature readings and determines the position of the beam 110, for example, relative to the center 244 or in spatial coordinates. The master controller 155 provides a signal to the steering mirror 214 sufficient to cause the reflective portion 215 to change positions to move the beam 110 into the center 244 of the lens 218.

As shown in FIGS. 5A and 5B, the steering mirror 214 moves in the directions "A" and "B" to move the beam 110 to the center 244 of the lens 218. The actuator 221 also moves the lens 218 in the direction "Z" to focus the beam 110. As a result of the adjustments, the beam 110 becomes symmetrical on the lens 218 and each of the temperature sensors 228A-228D measures approximately the same temperature. The beam 110 comes to a focus at the target location 105, and irradiates a droplet in the target mixture 114. The droplet is converted to a plasma and EUV light is emitted.

Thus, as compared to the example of FIGS. 4A and 4B, by positioning the beam 110 with the steering mirror 214 so that the beam 110 passes through the center 244 of the lens 218, the amount of generated EUV light increases. Further, the stability of the amount of EUV light also can improve because, by monitoring the alignment of the beam 110 relative to the lens 218, the beam 110 can focus more consistently at the target location 105, thereby producing a relatively constant amount of EUV light.

Figure 6:
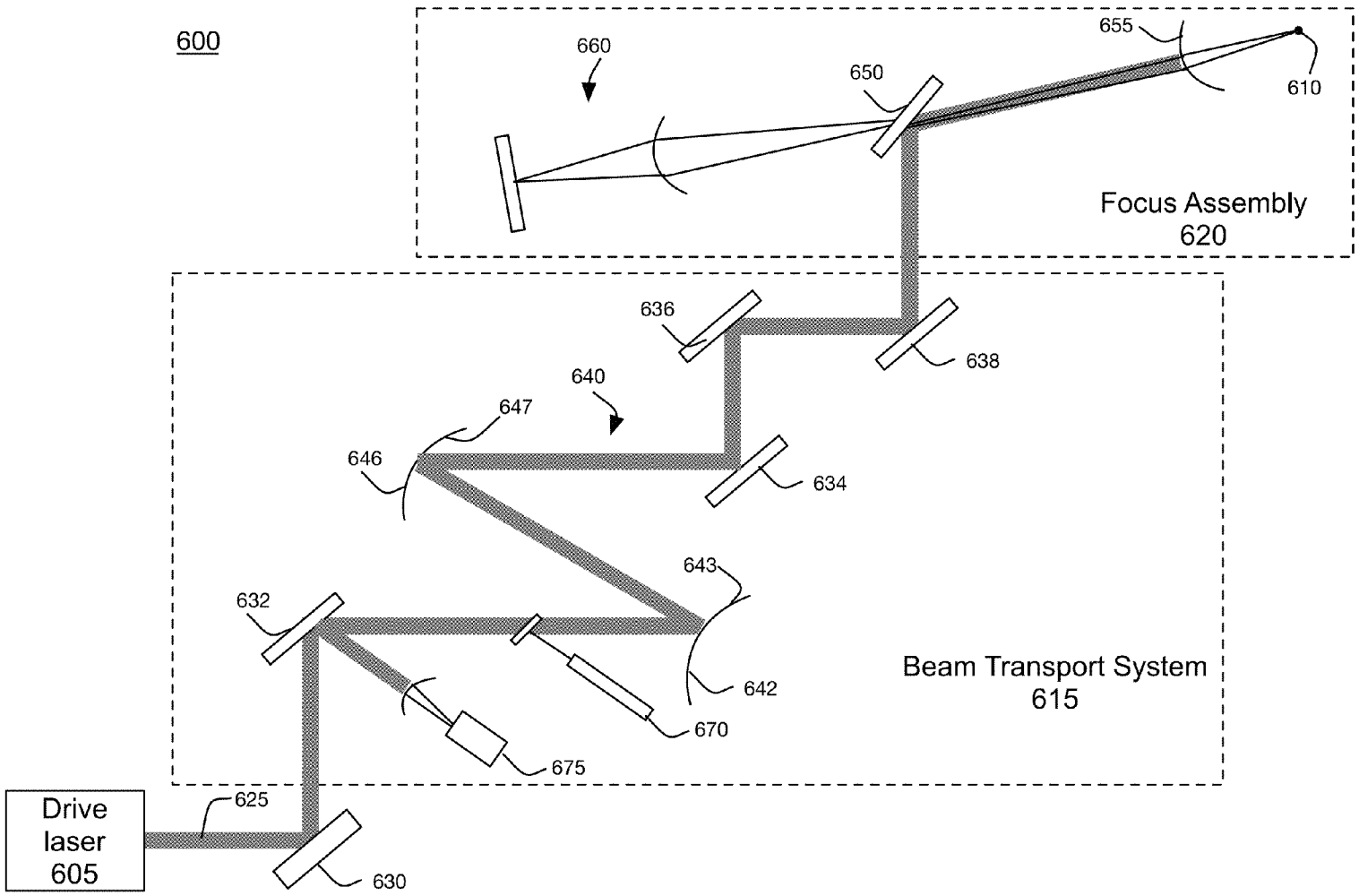
FIG. 6 is an illustration of an example beam delivery system.

Referring to FIG. 6, an exemplary beam delivery system 600 is positioned between a drive laser system 605 and a target location 610. The beam delivery system 600 includes a beam transport system 615 and a focus assembly 620. The beam transport system 615 can be used as the beam transport system 240, and the focus assembly 620 can be used as the final focus assembly 210.

The beam transport system 615 receives an amplified light beam 625 produced by the drive laser system 605, redirects and expands the amplified light beam 625, and then directs the expanded, redirected amplified light beam 625 toward the focus assembly 620. The focus assembly 620 focuses the amplified light beam 625 to the target location 610.

The beam transport system 615 includes optical components such as mirrors 630, 632 and other beam directing optics 634 that change the direction of the amplified light beam 625. The optical components 630, 632, 634, and 638 can be included in the steering module 242 of the beam transport system 240 (FIG. 2A).

The beam transport system 615 also includes a beam expansion system 640 that expands the amplified light beam 625 such that the transverse size of the amplified light beam 625 that exits the beam expansion system 640 is larger than the transverse size of the amplified light beam 625 that enters the beam expansion system 640. The beam expansion system 640 can include a curved mirror that has a reflective surface that is an off-axis segment of an elliptic paraboloid (such a mirror is also referred to as an off-axis paraboloid mirror). The beam expansion system 640 can include other optical components that are selected to redirect and expand or collimate the amplified light beam 625. Various designs for the beam expansion system 640 are described in an application entitled "Beam Transport System for Extreme Ultraviolet Light Source," U.S. patent application Ser. No. 12/638,092, which is incorporated herein by reference in its entirety.

As shown in FIG. 6, the focus assembly 620 includes a mirror 650 and a focusing element that includes a converging lens 655 configured and arranged to focus the amplified light beam 625 reflected from the mirror 650 to the target location 610. The converging lens 655 can be the focus lens 218, and the mirror 650 can be the steering mirror 214 in the example discussed with respect to FIG. 2A.

Therefore, at least one of the mirrors 630, 632, 638, and components within the beam directing optics 634, in the beam transport system 615, and the mirror 650, in the focus assembly 620, can be movable with the use of a movable mount that is actuated by an actuation system that includes a motor that can be controlled by the master controller 155 to provide active pointing control of the amplified light beam 625 to the target location 610. The movable mirrors and beam directing optics can be adjusted to maintain the position of the amplified light beam 625 on the lens 655 and the focus of the amplified light beam 625 at the target material.

The converging lens 655 can be an aspheric lens to reduce spherical aberrations and other optical aberrations that can occur with spherical lens. The converging lens 655 can be mounted as a window on a wall of the chamber, can be mounted inside the chamber, or can be mounted external to the chamber. The lens 655 can be movable and therefore it can be mounted to one or more actuators to provide a mechanism for active focus control during operation of the system. In this way, the lens 655 can be moved to more efficiently collect the amplified light beam 625 and direct the light beam 625 to the target location to increase or maximize the amount of EUV production. The amount and direction of displacement of the lens 655 is determined based on the feedback provided by the temperature sensors 228A-228D, discussed above, or the thermal sensor 710, discussed below.

The converging lens 655 has a diameter that is large enough to capture most of the amplified light beam 625 yet provide enough curvature to focus the amplified light beam 625 to the target location. In some implementations, the converging lens 655 can have a numerical aperture of at least 0.25. In some implementations, the converging lens 655 is made of ZnSe, which is a material that can be used for infrared applications. ZnSe has a transmission range covering 0.6 to 20 μm and can be used for high power light beams that are produced from high power amplifiers. ZnSe has a low thermal absorption in the red (specifically, the infrared) end of the electromagnetic spectrum. Other materials that can be used for the converging lens include, but aren't limited to: gallium arsenide (GaAs) and diamond. Moreover, the converging lens 655 can include an anti-reflective coating and can transmit at least 95% of the amplified light beam 625 at the wavelength of the amplified light beam 625.

The focus assembly 620 can also include a metrology system 660 that captures light 665 reflected from the lens 655. This captured light can be used to analyze properties of the amplified light beam 625 and light from the guide laser 175, for example, to determine a position of the amplified light beam 625 and monitor changes in a focal length of the amplified light beam 625.

The beam delivery system 600 can also include an alignment laser 670 that is used during set up to align the location and angle or position of one or more of the components (such as the mirrors 630, 632, the beam directing optics 634, components within the beam expansion system 640, and the pre-lens mirror 650) of the beam delivery system 600. The alignment laser 670 can be a diode laser that operates in the visible spectrum to aid in a visual alignment of the components.

The beam delivery system 600 can also include a detection device 675 such as a camera that monitors light reflected off the droplets in the target mixture 114 at the target location 610, such light reflects off a front surface of the drive laser system 605 to form a diagnostic beam 680 that can be detected at the detection device 675. The detection device 675 can be connected to the master controller 155.

Figure 7:
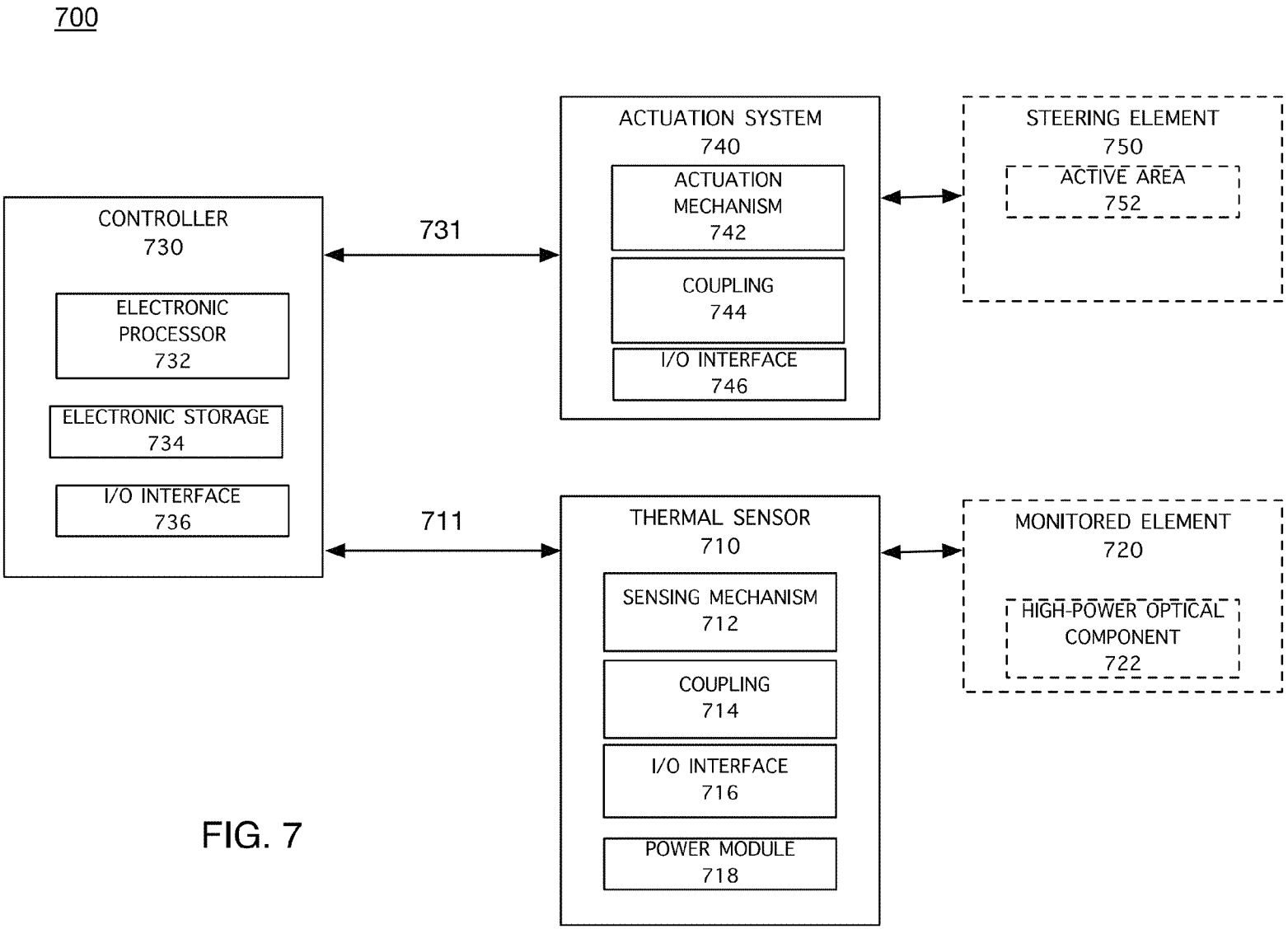
FIG. 7 is a block diagram of an example system that aligns an amplified light beam.

Referring to FIG. 7, a block diagram of an example system 700 that aligns an amplified light beam (or drive laser) in an EUV light source is shown. The system 700 includes a thermal sensor 710 that communicates with a monitored element 720 and with a controller 730. The controller 730 also communicates with an actuation system 740. The actuation system 740 is coupled to, and communicates with, a steering element 750.

The system 700 can align the drive laser (not shown) while the system 700 is in use by monitoring the temperature of the monitored element 720. The temperature is provided to the controller 730, and the controller 730 provides a signal 731 to the actuation system 740 that is sufficient to cause the steering element 750 to re-position the drive laser beam until the temperature of the monitored element 720 is approximately uniform. The drive laser beam can be aligned when the temperature of the monitored element 720 is approximately constant in time and/or space. Thus, the system 700 can be considered to provide active alignment of the drive laser beam.

The thermal sensor 710 can be any type of sensor that produces an indication of a temperature of the monitored element 720 when the sensor is placed on, in contact with, or close to, the monitored element 720. For example, the thermal sensor 710 can be one or more of a thermocouple, a fiber-based thermal sensor, or a thermistor. The thermal sensor 710 can include more than one thermal sensor, and the multiple thermal sensors can all be the same type, or they may be a collection of different types of thermal sensors.

The thermal sensor 710 includes a sensing mechanism 712, an input/output (I/O) interface 716, and a power module 718. The sensing mechanism 712 is an active or passive element capable of sensing heat and producing a signal or other indication of the amount of sensed heat. The I/O interface 716 allows the signal or other indication of sensed heat to be accessed and/or removed from the thermal sensor 710. The I/O interface 716 also allows a user of the system 700 to communicate with the thermal sensor 710 through, for example, a remote computer, to access the signal produced by the sensing mechanism 712. The thermal sensor 710 also can include a coupling 714 that connects the thermal sensor 710 to a surface or other portion of the monitored element 720. The coupling 714 can be a mechanical coupling that physically connects the thermal sensor 710 to the monitored element 720. The coupling 714 can be an element that holds the thermal sensor 710 close to the monitored element 720 but without physically connecting the thermal sensor 710 to the monitored element 720.

The thermal sensor 710 measures a temperature on a portion of the monitored element 720. The monitored element 720 can be any thermally conductive element in the vicinity of the high-power optical component 722. For example, the monitored element 720 is a physical component in the vicinity of a high-power optical component 722 that interacts with the drive laser beam through reflection or refraction. The high-power optical component 722 can be any component that interacts with the drive laser beam through reflection or refraction. For example, the high-power optical component 722 can be an optical element that is exposed to a large amount of laser power, such as a final focus lens (such as the lens 218), a window on a power amplifier (such as the input windows 189 and 193 and/or the output windows 185, 190, and 194), a steering mirror in the final focus lens assembly (such as the steering mirror 214), a mirror that is downstream of the final focus lens, and/or a spatial filter aperture (such as the aperture 197). More than one high-power optical component 722 can be monitored simultaneously.

The monitored element 720 can be considered to be in the vicinity of the component 722 if the temperature of the monitored element 720 is proportional to, or impacted by, the temperature of the component 722. For example, the monitored element 720 can be an element that holds, supports, or protects the component 722. For example, the monitored element 720 can be a heat shield that surrounds the final focus lens, a mirror mount that holds a mirror on one or more sides of the mirror, or a holder that holds a spatial filter. The monitored element 720 can be in physical contact with the component 722, but this is not necessarily the case, as the monitored element 720 and the component 722 can be physically separated from each other.

The thermal sensor 710 measures the temperature of the monitored element 720 in one or more locations on the monitored element. The thermal sensor 710 provides a signal representing the measured temperature at the one or more locations to the controller 730. In some implementations, the thermal sensor 710 measures the temperature of the monitored element 720 over a period of time and provides a time series of temperature measurements to the controller 730. The controller 730 analyzes the temperature measurements to determine whether the drive laser beam is properly aligned. Based on the analysis, the controller 730 can provide a signal 731 to the actuation system 740 that is sufficient to correct the alignment of the drive laser beam.

The controller 730 includes an electronic processor 732, an electronic storage 734, and an I/O interface 736. The electronic storage 734 stores instructions and/or a computer program that, when executed, cause the electronic processor 732 to perform actions. For example, the processor 732 may receive signals from the thermal sensor 710 and analyze the signals to determine that the temperature distribution on the monitored element 720 is spatially and/or temporally non-uniform, and, therefore, the drive laser beam is misaligned. The input/output (I/O) interface 736 may present data analyzed by the processor 732 visually on a display and/or audibly. The I/O interface 736 may accept commands from an input device (for example, an input device activated by a human operator of the system 700 or an automated process) to configure the thermal sensor 710, the actuation system 740 or update data or computer program instructions stored in the electronic storage 734.

The controller 730 provides a signal 731 to the actuation system 740 that is sufficient to cause the actuation system 740 to adjust a position of the steering element 750. The signal may include, for example, coordinates for a new location of the steering element 750 or a physical distance to move the steering element 750 in one or more directions. The signal is in a format capable of being accepted and processed by the actuation system 740, and the signal may be transmitted to the actuation system 740 through a wired or wireless connection.

The actuation system 740 includes an actuation mechanism 742, a coupling 744, and an I/O interface 746. The actuation mechanism 742 can be, for example, a motor, a piezoelectric element, a driven lever, or any other element that causes motion in another object. The actuation system also includes the coupling 744 that allows the actuation mechanism 742 to attach to an external element such that the external element can be moved by the actuation mechanism 742. The coupling 744 can be a mechanical coupling that makes physical contact with the external element, or the coupling 744 can be non-contact (such as a magnetic coupling). The I/O interface 746 allows an operator of the system 700 or an automated process to interact with the actuation system 740. The I/O interface 746 can, for example, accept a signal that is sufficient to cause the actuation mechanism 742 to move the steering element 750 from the operator instead of from the controller 730.

The steering element 750 is in contact with the actuation mechanism 742, and the steering element 750 moves in response to an action from the actuation mechanism 742. For example, the steering element 750 can be a platform, a portion of which moves when a piezoelectric element in the actuation mechanism 742 that is in contact with the portion of the platform expands. The steering element 750 includes an active area 752 that interacts with the drive laser beam. The motion of the steering element 750 causes a corresponding motion of the active area 752, and the change in position of the active area repositions the beam. For example, the active area 752 can be a mirror that reflects the beam, and positioning the mirror changes the direction in which the beam is reflected.

Figure 8:
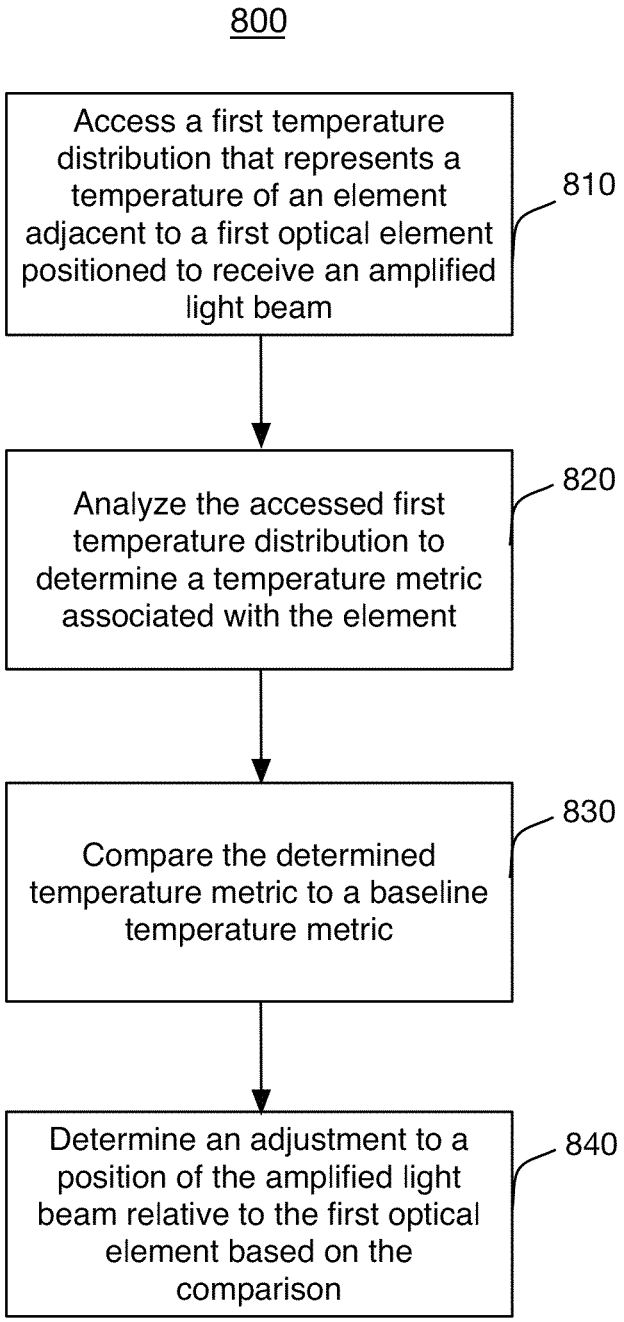
FIG. 8 is an example process for aligning an amplified light beam.

Referring to FIG. 8, an example process 800 for adjusting a position of an amplified light beam relative to an optical element is shown. The process 800 can be performed on an amplified light beam in an EUV light source, such as the amplified light beam 110 of the source 100 shown in FIG. 1A. The process 800 can be performed by one or more electronic processors that are included in an electronic component that controls the positioning of elements that steer the amplified light beam, such as the electronic processor 732 that is included in the controller 730 discussed with respect to FIG. 7.

A first temperature distribution is accessed (810). The first temperature distribution represents a temperature of a component that is adjacent to a first optical element. The first optical element is positioned to receive the amplified light beam 110. The component is adjacent to, or in the vicinity of, the first optical element when a temperature on the component is proportional to, or influenced by, the temperature of the first optical element. Thus, measuring a temperature of the component provides an indication of a temperature of the optical element, thereby allowing the temperature of the optical element to be measured indirectly. The component and the optical element can be in physical contact with each other, or the component and the optical element can be close enough to each other such that heating the optical element also heats the component.

The optical element receives the amplified light beam 110 by reflecting the beam 110, absorbing the beam 110, and/or transmitting the beam 110. The optical element can be any optical component in an EUV light source. The optical element can be, for example, a high-power optical element such as the final focus lens, an output window on a power amplifier, a final focus turning mirror, or a spatial filter aperture. The component in the vicinity of the optical element can, for example, hold or support the optical element.

The first temperature distribution can be a set of numerical values that represent temperature measurements taken by one or more temperature sensors that are on or near the component. Because the temperature of the component is related to the temperature of the optical element, the first temperature distribution provides an approximation of the temperature of the optical element. The first temperature distribution can be a set of numerical values that represent the temperature of a particular part of the component over a period of time. In some implementations, the first temperature distribution can be a set of numerical values that represent the temperature of multiple, different portions of the component at a period of time or at a particular instance.

The accessed first temperature distribution is analyzed to determine a temperature metric (820). The temperature metric can be a numerical figure of merit that is compared to a baseline value. The temperature metric can be any suitable mathematical construction related to the details of the temperature distribution on the optical element or a component that is adjacent to the optical element. For example, and as discussed further below, the temperature metric can be a measure of the spatial symmetry of the temperature distribution, such as a standard deviation or variance of temperatures measured at different locations on the adjacent optical element. The temperature metric can be a value, such as a variation or rate of temperature change, determined from a set of numerical values that represent the temperature of one or more of the sensors 228A-228D over time.

As discussed above, variations in the temperature on the optical element can indicate that the amplified light beam 110 is misaligned or has poor quality. Thus, analyzing the first temperature distribution to determine whether the temperature is relatively consistent can provide an indication of the beam alignment and beam quality. For example, the first temperature distribution can be analyzed by determining a measure of spatial symmetry. The measure of spatial symmetry can be computed by, for example, accessing temperature measurements taken by the four temperature sensors 228A-228D (FIG. 2A), which are approximately uniformly spaced along a surface of the lens holder 212 (FIG. 2A). At a particular time, the measurements from the temperature sensors 228A-228D each provide an indication of a temperature of a corresponding portion of the final focus lens 218. If the amplified light beam 110 passes through the lens 218 off center as shown in FIG. 4B, the values of the temperature readings from the temperature sensors 228A and 228C are greater than the values of the temperature readings from the temperature sensors 228B and 228D. The difference between the temperature readings from the sensors 228A-228D at a particular time indicates that the beam 110 is not centered on the lens 218.

The example discussed above relates to an instance where the beam 110 is not centered on the lens 218. In another example, if the beam 110 has a non-uniform intensity distribution, each of the sensors 228A-228D measure and produce a different temperature, with the highest temperature coming from the sensor that is closest to the portion of the beam 110 that has the highest intensity. Thus, by comparing the temperature values from each of the sensors 228A-228D, the beam 110 may be monitored to determine if there is a spatial non-uniformity in the intensity. If the temperature values from the sensors 228A-228D are different, then the beam 110 can be determined to have a spatial non-uniformity. The shape of the intensity distribution (the amount of intensity as a function of spatial location) can be approximated by ordering the temperature values provided by the sensors 228A-228D. The severity of the non-uniformity of the intensity can be determined by computing the variance or standard deviation of the temperatures measured by the sensors 228A-228D.

In another example, the first temperature distribution can be a set of numerical values that represent the temperature of one or more of the sensors 228A-228D over time. In this example, the first temperature distribution can be analyzed by computing the variance or standard deviation of a time series of temperature values measured by any one of the sensors 228A-228D. Under optimal or acceptable operating conditions, the amplified light beam 110 is aligned to focus at the target location 105, and the beam 110 does not change position relative to an optical element with which the beam 110 interacts. If the beam 110 changes position relative to the optical element over a period of time and/or if the beam profile of the beam 110 changes over time, the intensity distribution on the optical element also changes. As a result, the temperature measured by the each of the sensors 228A-228D also changes when the beam 110 becomes misaligned. Analyzing the first temperature distribution to determine the variance of the distribution and/or the rate of change of the temperature as a function of time can provide an indication as to whether the position or profile of the beam 110 is changing.

The temperature metric determined in (820) is compared to a baseline temperature metric (830). The baseline temperature metric can be a value of a metric that is determined when the light source is operating in an acceptable or optimal manner. The determined temperature metric can be compared to the baseline temperature metric by, for example, subtracting the determined temperature metric from the baseline temperature metric to determine a difference between the two. The difference may be compared to a threshold to determine whether the amplified light beam 110 is misaligned or would otherwise benefit from an adjustment. For example, a change in temperature measured by a particular temperature sensor of more than two degrees Celsius can indicate that the amplified light beam 110 has become misaligned.

The amplified light beam 110 is adjusted based on the comparison (840). For example, if the temperature measured by the sensor 228A increases by 4° C. over a period of time, and the temperature measured by the sensor 228C decreases by 4° C. over the same period of time, then the beam 110 is determined to have moved to a portion of the lens 218 that is closer to the sensor 228A. An adjustment to move the reflective portion 215 in the direction "X" to move the beam 110 in a corresponding direction towards the sensor 228C is determined. The adjustment can be a signal produced by the master controller 155. The signal can include information that specifies an amount of movement by the actuator 216. When the actuator 216 receives and processes the signal, the actuator 216 causes the reflective portion 215 to move such that the beam 110 moves lower on the lens 218.

Other implementations are within the scope of the following claims.

What is claimed is:

1. A method for adjusting a position of an amplified light beam relative to a first optical element in an extreme ultraviolet (EUV) light source, the method comprising:

accessing a first temperature distribution of a monitored element that is adjacent to and distinct from the first optical element, the first temperature distribution comprising a plurality temperature distributions, each of the plurality of temperature distributions comprising at least one numerical value that represents a temperature of one of a plurality of distinct spatial locations on the monitored element, the first optical element being positioned to receive the amplified light beam, and the temperature of each of the plurality of distinct spatial locations on the monitored element being an indirect measurement of a temperature of one of a plurality of portions of the first optical element;

determining a temperature metric from each of the plurality of temperature distributions, each temperature metric being associated with one of the distinct spatial locations on the monitored element;

comparing the plurality of determined temperature metrics to each other;

determining whether the amplified light beam is at a center of the first optical element, the amplified light beam being at the center of the optical element when the plurality of determined temperature metrics are substantially the same and the amplified light beam being off-center relative to the first optical element when the plurality of determined temperature metrics are not substantially the same; and if the amplified light beam is off-center relative to the optical element, adjusting the position of the amplified light beam relative to the first optical element until the amplified light beam is closer to the center of the first optical element.

2. The method of claim 1 wherein adjusting the position of the amplified light beam comprises producing an indication that represents the adjustment to the position of the amplified light beam.

3. The method of claim 2, wherein:

the indication comprises inputs for an actuator mechanically coupled to a second optical element, the second optical element comprises an active area positioned to receive the amplified light beam, and the inputs to the actuator are sufficient to cause the actuator to move the active area in at least one direction.

4. The method of claim 3 further comprising providing the inputs to the actuator.

5. The method of claim 4 further comprising:

accessing, after providing the inputs to the actuator, a plurality of second temperature distributions, each of the plurality of second temperature distributions representing a temperature of one of the plurality of distinct spatial locations on the monitored element;

determining the plurality of temperature metrics from the plurality of second temperature distributions; and comparing the temperature metrics determined from the second temperature distributions to one or more of the first temperature distribution or to each other.

6. The method of claim 3, wherein the active area of the second optical element comprises a mirror having a reflective portion that receives the amplified light beam, and when moved, changes the position of the amplified light beam relative to the first optical element.

7. The method of claim 3, wherein the indicator further comprises inputs for a second actuator coupled to a third optical element in the EUV light source, the inputs to the second actuator being sufficient to cause the second actuator to move the third optical element in at least one direction.

8. The method of claim 1, wherein the temperature of each of the distinct spatial locations on the monitored element is measured at least at two different times.

9. The method of claim 1, wherein each of the plurality of temperature distributions comprise data that represents temperature measurements received from thermal sensors mechanically coupled to the monitored element.

10. The method of claim 1, wherein the first optical element comprises a lens through which the amplified light beam passes, and the monitored element comprises a lens shield that surrounds an outer edge of the lens.

11. The method of claim 1, wherein the temperature distributions comprise multiple temperatures of the distinct spatial locations on the monitored element measured at different times, and the temperature metrics comprise one or more of a variance of the multiple temperatures, an average of the multiple temperatures, or a rate of change between of at least two of the multiple temperatures.

12. The method of claim 11, wherein the temperature metrics comprise a spatial variance of the multiple temperatures.

13. The method of claim 12, wherein the plurality of temperature metrics comprise a spatial variance of the multiple temperatures measured at the distinct spatial locations on the monitored element.

14. The method of claim 1, wherein the temperature metrics comprise a value representing a temporal change in measured temperature of the monitored element.

15. A system comprising:

a thermal sensor system comprising a plurality of thermal sensors, each of the thermal sensors configured to:

mechanically couple to a monitored element at a particular location on the monitored element, the monitored element being adjacent to and distinct from a first optical element that receives an amplified light beam of an extreme ultraviolet (EUV) light source, measure a temperature of the particular location of the monitored element, the temperature of the particular location of the monitored element being indicative of a temperature of a portion the first optical element, and generate an indication of the measured temperature of the particular location of the monitored element; and a controller comprising one or more electronic processors coupled to a non-transitory computer-readable medium, the computer-readable medium storing software comprising instructions executable by the one or more electronic processors, the instructions, when executed, cause the one or more electronic processors to:

receive the generated indication of the measured temperature of the distinct spatial locations on the monitored element from the plurality of thermal sensors, compare the received indications of the measured temperature of the distinct spatial locations, determine whether the amplified light beam is at a center of the first optical element, the amplified light beam being at the center of the first optical element when the received indications of the measured temperature of the distinct spatial locations are substantially the same and the amplified light beam being off-center relative to the first optical element when the indications of the measured temperature of the distinct spatial locations are not substantially the same, and produce an output signal based on the received indications of the measured temperature when the amplified light beam is off-center relative to the first optical element, the output signal being sufficient to cause an actuator to move a second optical element that receives the amplified light beam and adjust a position of the amplified light beam relative to be closer to the center of the first optical element.

16. The system of claim 15, wherein the instructions further comprise instructions to provide the output signal to the actuator, and wherein the actuator is configured to couple to the second optical element.

17. The system of claim 15, wherein:

the first optical element is a lens through which the amplified light beam passes, the element adjacent to the first optical element is a lens shield adjacent to and surrounding an outer edge of the lens, and the thermal sensor is configured to be mounted to the lens shield.

18. The system of claim 15, wherein the plurality of thermal sensors comprise one or more of thermocouple, a thermistor, or a fiber-based thermal sensor.

19. The system of claim 15, wherein the instructions further comprise instructions that, when executed, cause the controller to:

access a plurality of temperature distributions, each of the temperature distributions being based on indications of the measured temperature of one of the particular locations of the monitored element from one of the thermal sensors;

determine a temperature metric associated with each particular location of the monitored element from the accessed plurality of temperature distributions;

compare the determined temperature metrics to a baseline temperature distribution; and adjust a parameter of the amplified light beam based on the comparison.

20. The system of claim 15, wherein the first optical element comprises one or more of a power amplifier output window, a final focus turning mirror, or a spatial filter aperture.

21. The system of claim 15, wherein the first optical element comprises one or more optical elements that are downstream of a lens that focuses the amplified light beam, and each of the one or more optical elements are coupled to more than one of the plurality of thermal sensors.

22. A system comprising:

a first optical element positioned to receive an amplified light beam of an extreme ultraviolet (EUV) light source, the first optical element comprising a center and a perimeter;

a monitored element in physical contact with the first optical element, the monitored element being positioned away from the center and at the perimeter of the first optical element, a temperature of the monitored element being indicative of a temperature of the first optical element;

a thermal system coupled to the monitored element, the thermal system comprising:

a plurality of temperature sensors, each of the temperature sensors coupled to a different portion of the monitored element, and each of the temperature sensors configured to generate an indication of a measured temperature of an associated portion of the monitored element that includes the portion of the monitored element to which the temperature sensor is coupled;

an actuation system coupled to a second optical element that, when moved, causes a corresponding movement in the amplified light beam; and a control system connected to an output of the thermal system and to one or more inputs of the actuation system, the control system configured to:

compare the generated indications of the measured temperatures, determine whether the amplified light beam is at the center of the first optical element, the amplified light beam being at the center of the first optical element when the indications of the measured temperature of the distinct spatial locations are substantially the same and the amplified light beam being off-center relative to the first optical element when the indications of the measured temperature of the distinct spatial locations are not substantially the same, and when the amplified light beam is off-center relative to the first optical element, produce an output signal for the actuation system inputs based on the generated indication of the measured temperature, the output signal being sufficient to cause an actuator the actuation system to move the second optical element and adjust a position of the amplified light beam closer to the center of relative to the first optical element.

23. The method of claim 10, wherein the lens comprises a converging lens.

24. The method of claim 1, further comprising:

indirectly determining a temperature of at least a portion of the first optical element that receives the amplified light beam based on the accessed first temperature distribution.

25. The method of claim 1, wherein the temperature of the element adjacent to and distinct from the first optical element is proportional to the temperature of the first optical element.

26. The method of claim 1, wherein the center of the optical element and a center of the distinct spatial locations on the monitored element coincide.

27. The method of claim 1, wherein the plurality of temperature metrics are substantially the same when the at least one numerical value of the temperature distributions are within 4 degrees Celsius of each other at a particular time.

28. The system of claim 22, wherein the first optical element is mounted on the monitored element.

* * * * *